US011708134B2

(12) United States Patent
Owen, III

(10) Patent No.: US 11,708,134 B2
(45) Date of Patent: Jul. 25, 2023

(54) JET WASH DEFLECTOR

(71) Applicant: Miller W. Owen, III, Panama City, FL (US)

(72) Inventor: Miller W. Owen, III, Panama City, FL (US)

( * ) Notice: Subject to any disclaimer, the term of this patent is extended or adjusted under 35 U.S.C. 154(b) by 267 days.

(21) Appl. No.: 17/154,947

(22) Filed: Jan. 21, 2021

(65) Prior Publication Data

US 2021/0269122 A1 Sep. 2, 2021

Related U.S. Application Data

(60) Provisional application No. 62/963,887, filed on Jan. 21, 2020.

(51) Int. Cl.

| | |
|---|---|
| ***B63B 34/70*** | (2020.01) |
| ***B63B 27/14*** | (2006.01) |
| ***B63B 34/75*** | (2020.01) |
| *B63B 29/02* | (2006.01) |

(52) U.S. Cl.

CPC ..... *B63B 27/14* (2013.01); *B63B 27/146* (2013.01); *B63B 34/70* (2020.02); *B63B 34/75* (2020.02); *B63B 2029/022* (2013.01)

(58) Field of Classification Search

CPC ..... B63B 3/46; B63B 17/00; B63B 27/14; B63B 27/146; B63B 34/70; B63B 34/75; B63B 2029/022

See application file for complete search history.

(56) References Cited

U.S. PATENT DOCUMENTS

| | | | | |
|---|---|---|---|---|
| 7,578,715 | B2 * | 8/2009 | Wilkie | B63B 34/60 441/79 |
| 2017/0320552 | A1 * | 11/2017 | Taylor | B63H 25/44 |
| 2021/0284292 | A1 * | 9/2021 | Moore | B63B 34/75 |

* cited by examiner

*Primary Examiner* — Andrew Polay
(74) *Attorney, Agent, or Firm* — Adrienne Love

(57) ABSTRACT

The present invention comprises a device for acting on water flow as a watercraft moves through the water. The device is generally comprised of a primary plate having two downward angled tabs and a handle. Device is installed on the stern of watercraft, preferably engaged to a prior art ladder. The angular tabs and primary plate delay a portion of the wake from reaching the surface of the water, thereby allowing time for the converging water flow from either side of the watercraft to merge more seamlessly with the wake. This convergence creates a more laminar surf wave.

10 Claims, 21 Drawing Sheets

JET WASH DEFLECTOR

CROSS-REFERENCES TO RELATED APPLICATIONS

Pursuant to the provisions of 37 C.F.R. § 1.53(c), this non-provisional application claims the benefit of an earlier-filed provisional patent application. The earlier application was assigned Ser. No. 62/963,887.

STATEMENT REGARDING FEDERALLY SPONSORED RESEARCH OR DEVELOPMENT

Not Applicable

MICROFICHE APPENDIX

Not Applicable

BACKGROUND OF THE INVENTION

1. Field of the Invention

This invention relates to the field of devices made for directing water flow as a watercraft moves through the water. More specifically, the invention comprises a device and method for redirecting a portion of the jet wash and jet stream to achieve a desired surfing wave.

2. Description of the Related Art

A jet boat generates a wake (or wave) moving through a body of water. As the boat moves forward the water is displaced, and energy is required to push the water out of the way of the hull. For boats to move quickly through the water the displacement of the watercraft can be reduced by either reducing the weight of the watercraft or shaping the hull to generate lift as it moves through the water.

However, when engaged in water sports, it is often desirable for the boat to displace a greater amount of water, in order to create a larger wake or wave. Wake sports, in particular, involve riding a wake while being towed by a watercraft. Often the wake rider wishes to jump the wake from side to side to do aerial tricks. To increase displacement of the water, wakeboarding boats typically include a ballast system that pumps water into specific tanks at different locations about the boat. When the water fills the tanks, the boat is weighed down by the tank resulting in a larger displacement and therefore a larger wake. The prior art ballast systems allow for increasing weight on different sides of the boat as well. For example, activating the port side ballast, will give a rider surfing on the port side a better wave.

Other prior art systems include devices that act to pull the stern of the boat lower in the water—again—creating greater water displacement and a higher wave. In one prior art system, shown in FIG. 1, two flaps 12, 14 (port, starboard) act to deflect water traveling past the stern of the boat 16. FIG. 1 illustrates the port side flap 12 operated by an actuator 18 in an outward position. When in this position the port side wave is redirected outward, creating additional drag on the boat and causing the port side wave to converge with the other waves at a point further away from the stern than is typical. However, these systems are complicated, expensive and cannot be retrofitted to any jet boat. Additionally, these systems do not directly affect the jet wash (escaping from under the boat) and jet spray which acts like a blast of water traveling generally in a rearward direction from the stern of the boat and can greatly affect the surf wave in a negative manner.

Therefore, what is needed is a device which attaches easily to an existing jet boat and redirects water flow, including jet wash and jet spray in an efficient manner avoiding significantly increasing drag and creating a clean, large wave. The present invention achieves this objective, as well as others that are explained in the following description.

BRIEF SUMMARY OF THE INVENTION

Device deflects water that is escaping upwards from jet nozzles and beneath the watercraft, as that watercraft moves through a body of water. By redirecting the flow of the water, device creates a clean, large wave behind the watercraft for purposes of surfing. Device has a primary plate, a handle, a foam piece and a down stop member. Primary plate has a central region and two wing regions with two angularly displaced tabs (or wings). Tabs are angularly displaced from primary plate (central segment of primary plate) by approximately 90 degrees (with an optimal range of approximately 90 to 120 degrees). Handle is shaped to include a base, top portion and two arms that extend outward past base. An opening is positioned at the center of handle. The two arms of handle engage with the sides of a prior art ladder when installed on watercraft. At least one foam piece is affixed to the top of device. Foam piece is buoyant such that device will not sink in water if dislodged from watercraft. Additionally, foam piece can be bright in color and include a warning, such as "No Step" for safety purposes.

In another embodiment, device includes a secondary plate that is engaged with primary plate. Secondary plate rests on top of primary plate and is connected to primary plate such that primary plate is capable of pivoting about a first point on secondary plate. In this embodiment, the central and wing regions of primary plate are extended such that central region is capable of pivoting under secondary plate while wing regions remain uncovered by secondary plate.

Device is installed by sliding device under prior art ladder at the stern of the watercraft. Device is held at an angle such that handle can fit through the opening between the two sides of ladder (above rungs of ladder). Once arms are pushed through the ladder opening, the device is straightened out and arms of handle rest on top of either side of the prior art ladder. Primary plate or, in another embodiment, secondary plate, rest directly under prior art ladder. Primary or secondary plate and arms of handle form a detent into which each side of prior art ladder rest. The central foam piece fits into the prior art ladder opening to provide additional stability. Finally, a strap can be affixed directly or indirectly to the primary or secondary plate in order to wrap around rungs of ladder. In the alternative, a secondary handle attached to either primary or secondary plate, can be used which optionally includes a strap and/or at least two molded rings on either side capable of engaging with side of ladder.

In use, device redirects water flow (including errant spray) swelling upward from beneath the center of the stern of the watercraft as it moves through the water. The redirection of escaping water downward (or purposeful delay in allowing water to reach surface) allows water passing along the side of the boat to converge with the wake (rearward water flow created by jet thrust and/or water disturbed by movement of boat through water) more seamlessly, creating more laminar flow that maintains a favorable environment for the converging flow to pass over the wake thereby dampening the effect of the volatile turbulent flow of the wake. In one embodiment the redirection of flow of the wake is downward at a 20-degree angle from the horizontal plane. Converging flow causes the formation of a desirable surfing wave.

REFERENCE NUMERALS IN THE DRAWINGS

Figure 1:
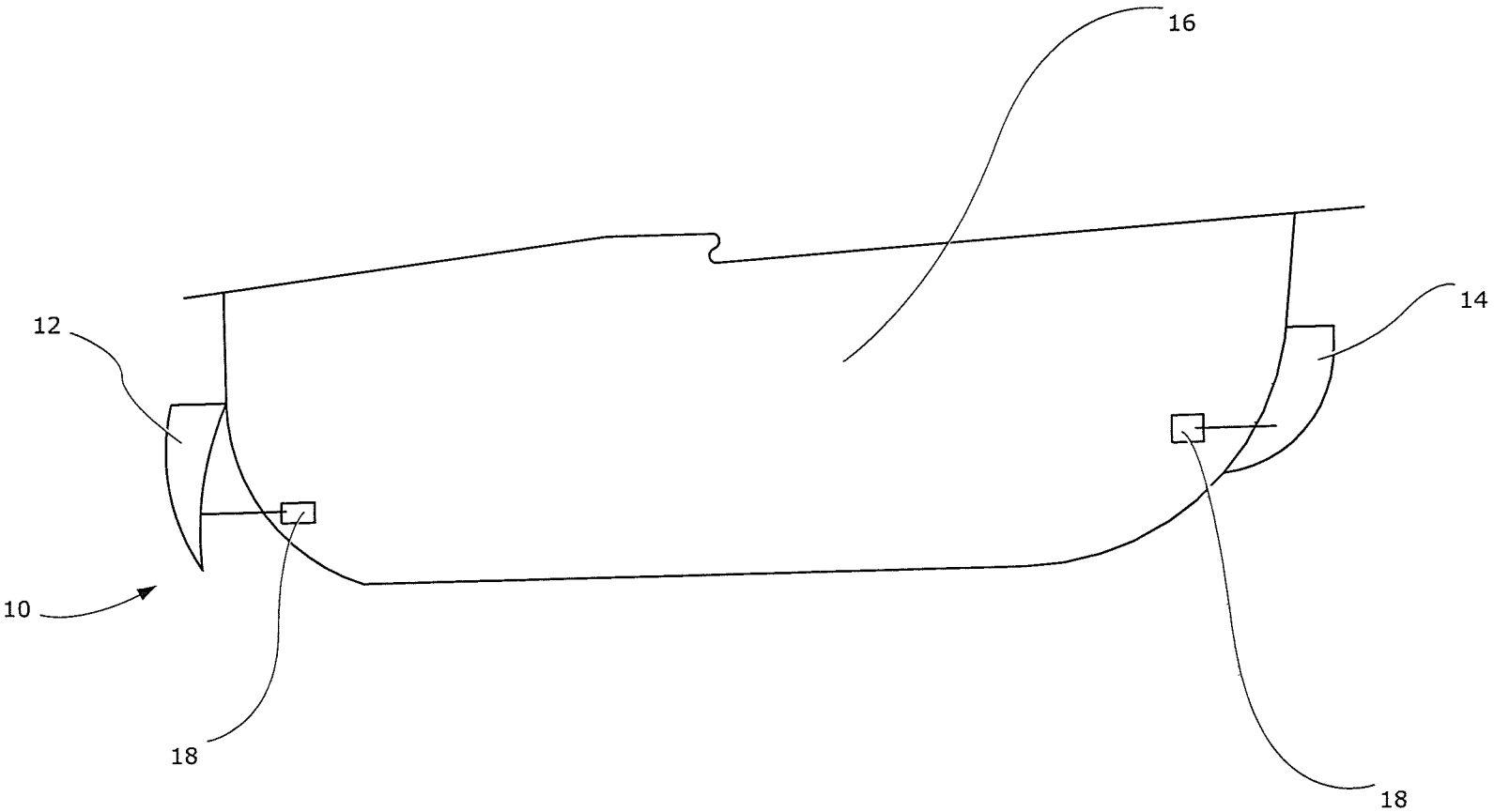
FIG. 1 (PRIOR ART)
FIG. 1 is a schematic view, showing a prior art invention.

10 prior art deflector system
12 port side deflector
14 starboard side deflector
16 watercraft
18 actuator
20 device
22 handle
24 central foam piece
26 primary plate
28 secondary plate
30 latch
32 down stop member
34 wing foam piece
36 starboard side tab
38 port side tab
40 adjustment slot
42*a* first hole (on secondary plate) (first point)
42*b* first hole (on primary plate) (first point)
42*c* first hole (down stop member)
44*a* second hole (secondary plate)
44*b* washer
46*a* adjustment hole (secondary plate)
46*b* washer
48*a* third hole (secondary plate)
48*b* washer
50 wing segment
52 central segment
54 bolt
56 nut
58 holes
60 flap
62 tab
64 ladder
66 strap
68 hull
70 ladder bracket
72 second handle
74 base portion
76 top portion
78 arm
80 opening

DETAILED DESCRIPTION OF THE INVENTION

Figure 13:
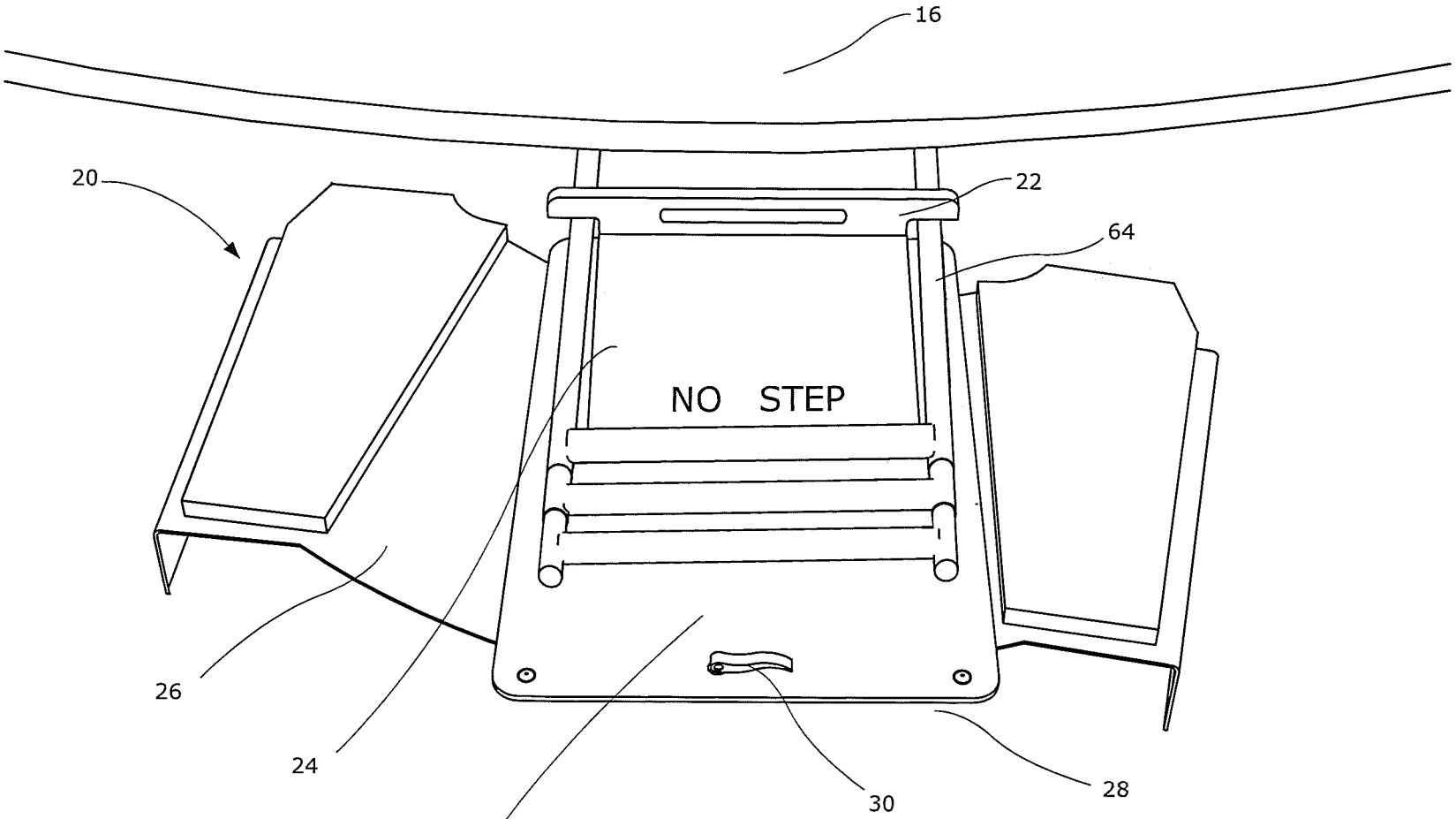
FIG. 13 is a perspective view, showing the present device installed on a ladder extending from a watercraft.

The jet wash deflector, in its first embodiment includes a primary plate capable of pivoting (FIG. 2), preferably for use in connection with a 24-foot watercraft or longer. In a second embodiment, primary plate is stationary (FIG. 13). The second embodiment is preferably for use in connection with a 23-foot watercraft or shorter. Each embodiment will be fully described herein. For purposes of this disclosure, use of the term "approximately" or "approximate" shall mean "at least 95% true" or "at least 95% of the number (angle) specified."

Figure 2:
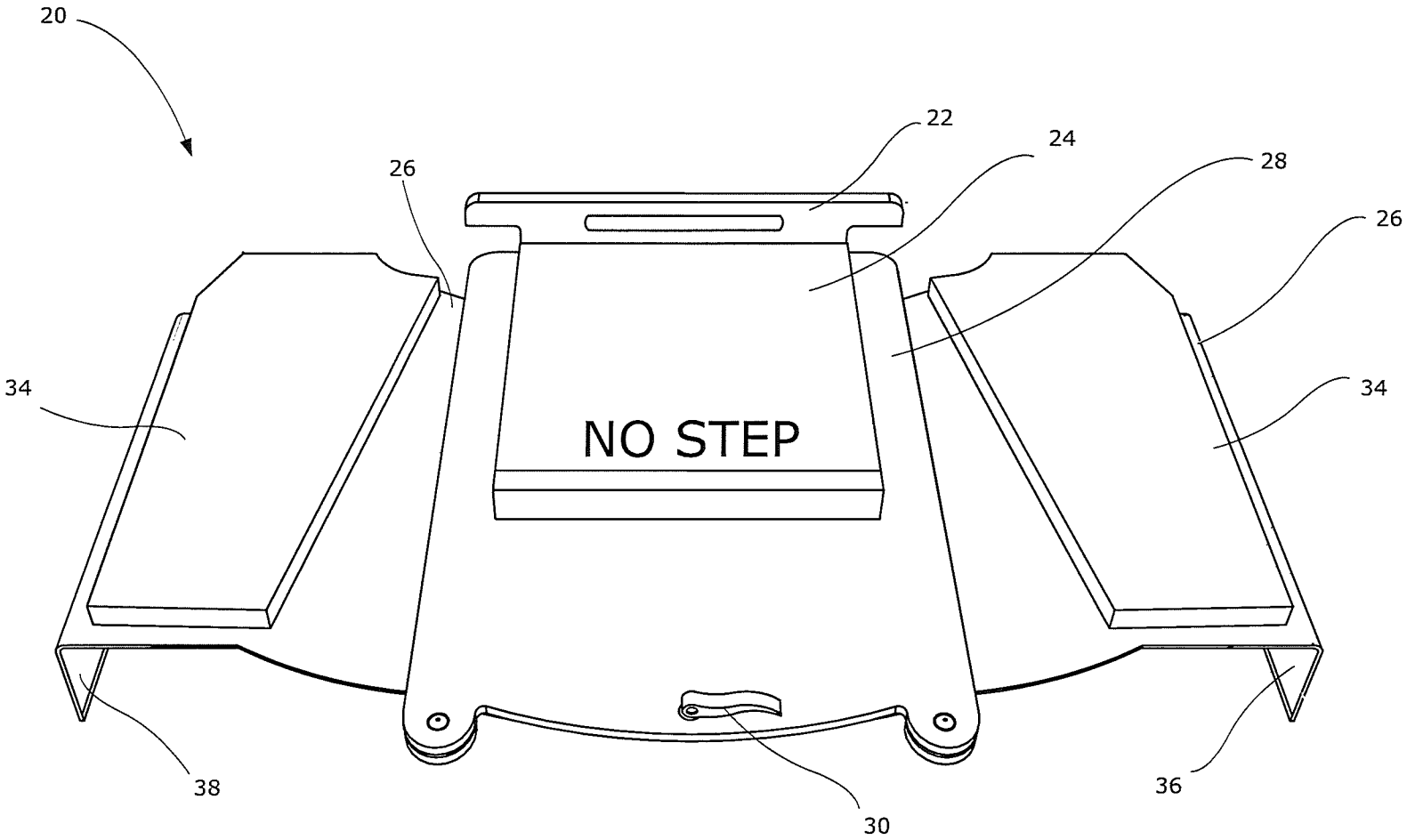
FIG. 2 is a perspective view, showing the present invention.

FIG. 2 illustrates the present invention in one embodiment. The reader will appreciate that device 20 is illustrated as if the reader was standing behind the watercraft looking at the stern of the boat. Thus, the left side of FIG. 2 will correspond to the port side of the watercraft when installed and the right side of FIG. 2 corresponds to the starboard side of the watercraft when installed. Device 20 is generally comprised of a primary plate 26 that includes two tabs (36, 38) extending downward from either side of primary plate at an angle of approximately 90-degree angle (angle is formed between primary plate and each tab). A secondary plate 28 is located on top of primary plate 26. Secondary plate 28 connects with a series of washer or "pucks" underneath primary plate 26 to engage primary plate 26, while still allowing primary plate 26 to pivot (shown in FIG. 10). Latch 30 engages with secondary plate 28 and a washer and nut opposite primary plate 26 to hold primary plate 26 in the desired position by frictional engagement. Secondary plate 28 optionally includes a handle 22 and foam piece 24 (additional foam pieces can also be attached in other areas on secondary plate 28). Foam piece 24 is preferably brightly colored and buoyant so that if device 20 is dislodged from the watercraft, it will float. As an additional advantage, the user can set device 20 in the water while preparing to install device 20. Two optional wing foam pieces 34 can be affixed to the outer right and left side of primary plate 26 (on wing segment 50, shown in FIG. 6) to assist with buoyancy of device. Foam piece 24 and wing foam pieces 34 also provide rigidity to the device (as they are adhered to the device in a preferable ¾ inch thick piece), warning messages and visibility. Starboard tab 36 and port side tab 38 extend in a perpendicular (downward) position from the outermost edge of primary plate 26. Tabs 36, 38 can be fully integrated with primary plate 26. The functionality of tabs 36, 38 is described in detail herein.

Figure 3:
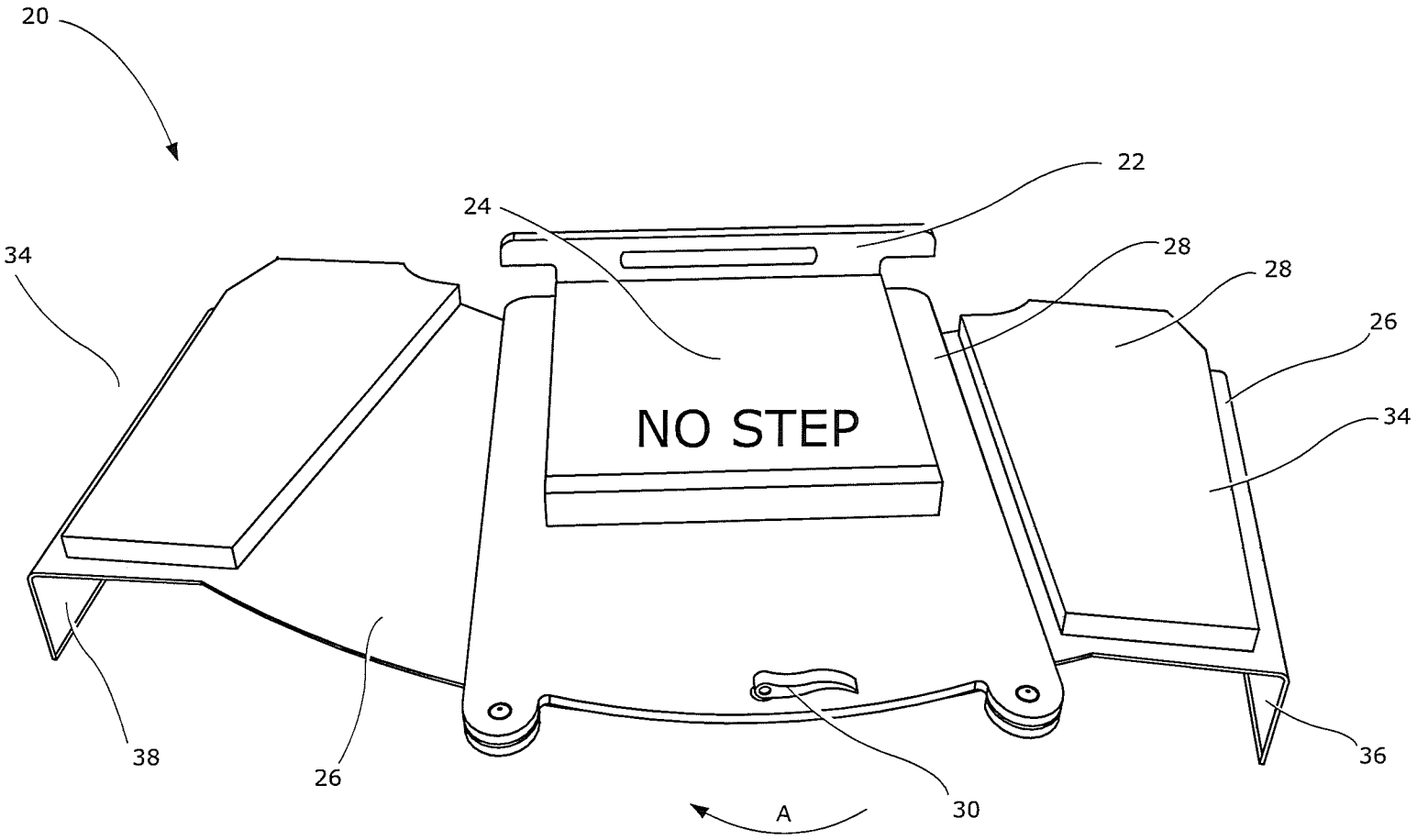
FIG. 3 is a perspective view, showing the present device extending toward the port-side of a watercraft.
Figure 4:
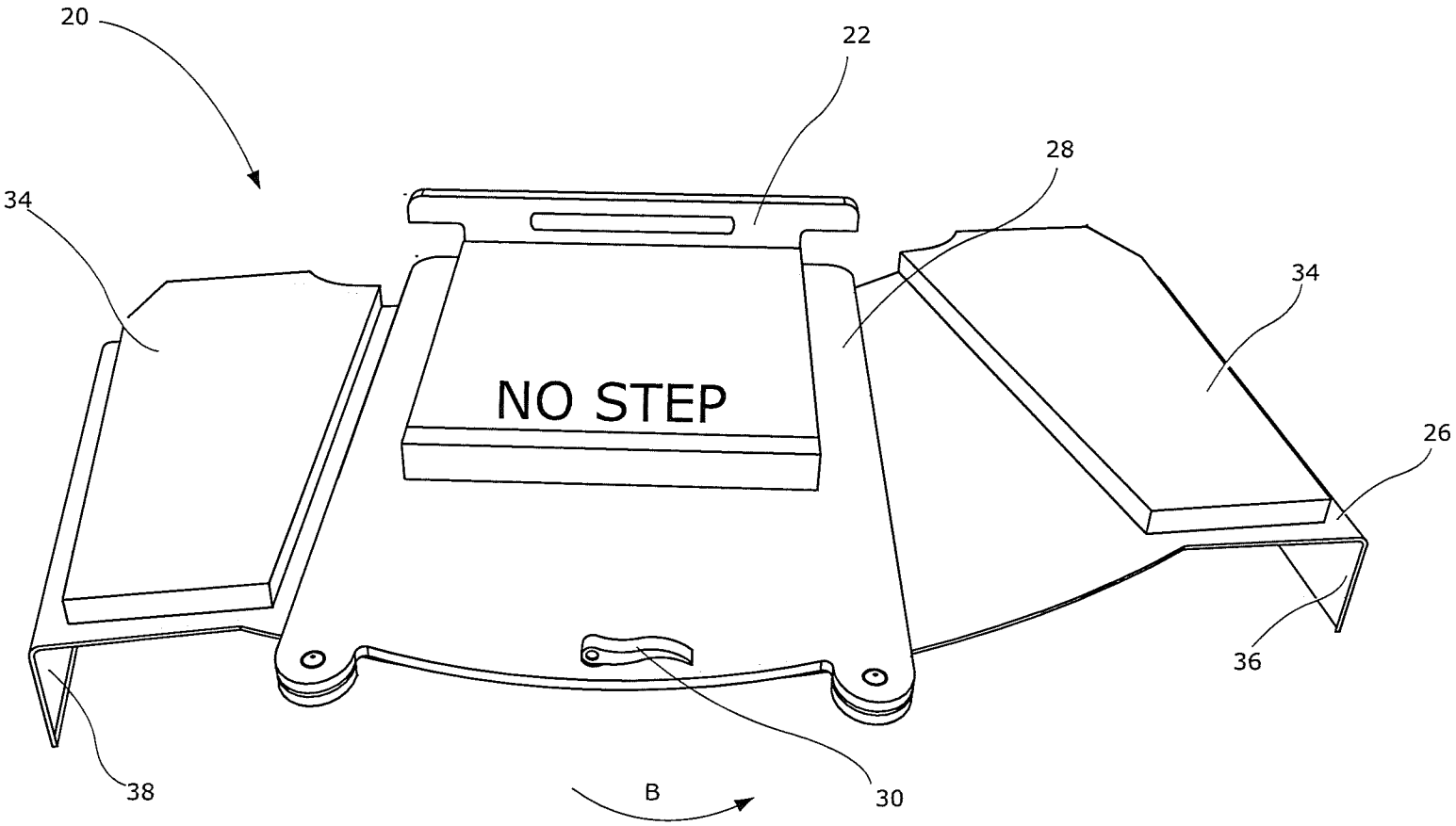
FIG. 4 is a perspective view, showing the present device extending toward the starboard side of a watercraft.

In the first embodiment, primary plate 26 can shift or pivot with respect to secondary plate 28, in the direction shown in arrow A, when latch 30 is disengaged (open position). FIG. 3 illustrates primary plate 26 pivoted (along adjustment slot) and locked into place toward the port side of the watercraft (when installed). As shown, primary plate 26 is pulled as far as possible toward the port side of the watercraft. Naturally, less of the starboard side of primary plate 26 is visible as it has shifted underneath secondary plate 28. FIG. 4 shows primary plate 26 pivoted and locked into place toward the starboard side of the watercraft (when installed). Arrow B shows the direction in which primary plate 26 shifts with respect to secondary plate 28.

Figure 5:
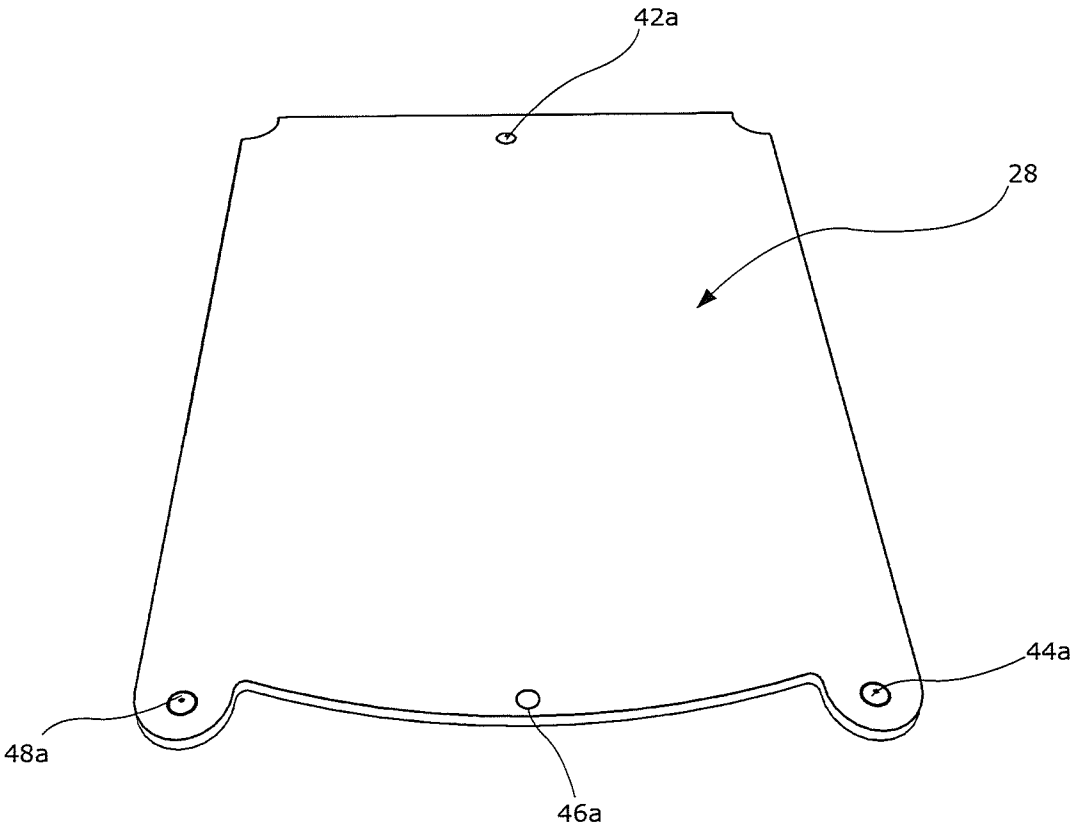
FIG. 5 is a perspective view, showing the secondary plate of the present device.
Figure 6:
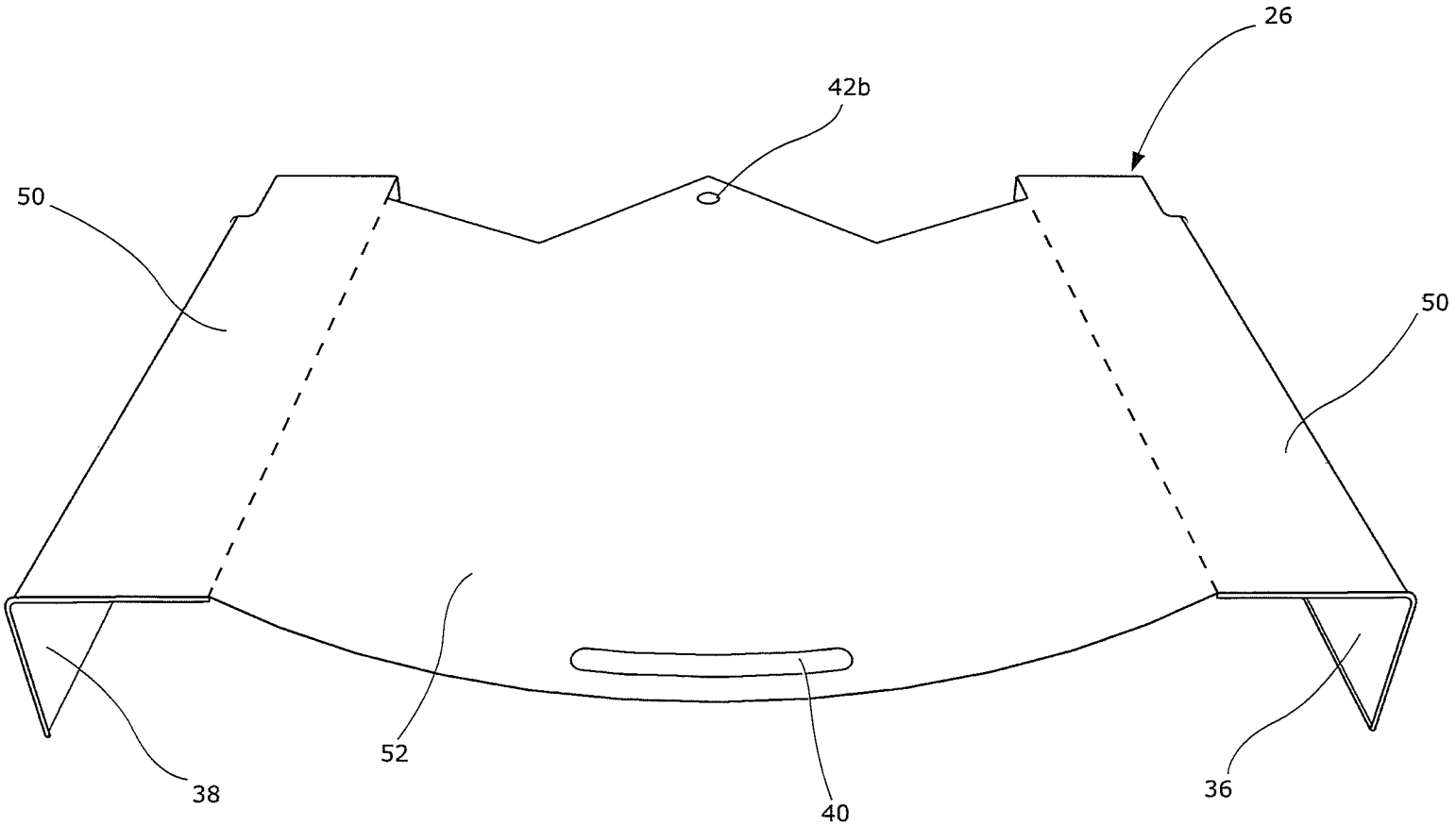
FIG. 6 is a perspective view, showing the primary plate of the present device.
Figure 7:
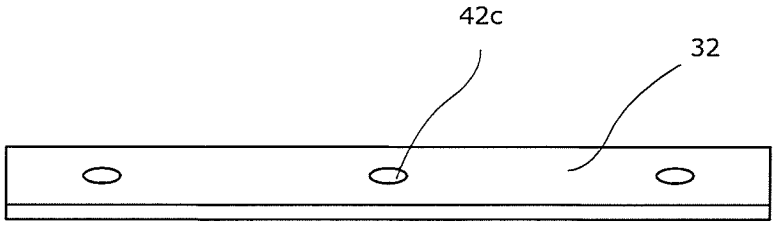
FIG. 7 is a perspective view, showing the down stop member of the present device.

FIGS. 5-7 show the component parts of the present invention. FIG. 5 shows secondary (top) plate 28 having first hole 42*a* ("first point" about which primary plate pivots), second hole 44*a*, third hole 48*a* and adjustment hole 46*a*. Additional holes may be necessary to secure additional parts, such as a second handle 72 (shown in FIG. 14). Secondary plate 28 can be made of any durable material. For example, secondary plate 28 can be made of aluminum, fiberglass or a composite material, to name a few. FIG. 6 shows primary plate 26 in its first embodiment. In this embodiment, primary plate 26 has a unique shape to allow primary plate 26 to pivot about first hole (42*b*) or "first point." As primary plate 26 pivots with respect to secondary plate 28, adjustment slot 40 allows the user to pivot primary plate 26 into a specific range of desired positions. Upon selecting the desired position, latch 30 assembly can be used to secure primary plate 26 in place with respect to secondary (top) plate (not shown). Primary plate 26 can also be made of aluminum, fiberglass or a composite material; however, primary plate 26 is not limited to these materials. Primary plate 26 generally has a first hole 42*b* ("first point" about which primary plate 26 pivots), adjustment slot 40 and two tabs 36, 38 that extend downward away from horizontal plane of plate 26. Tabs 36, 38 are preferably fully integrated with primary plate 26, but the reader will appreciate that tabs could be separately secured to primary plate 26.

In order to describe the shape of primary plate 26, in this embodiment, FIG. 6 includes two dotted lines. The reader will appreciate that primary plate 26 is one integrated piece and appears seamless, but for description purposes, the figure shows specific parts of the primary plate 28. Central segment 52 includes a curved lower side (proximate adjustment slot 40) that extends outward to two wing segments 50 (begin when curve ends). The upper side (proximate first hole 42*b*) of central segment 52 forms a rough or approximate "W" shape. On either end of the "W" the top end of wing segments 50 have two extended areas, having a downward flap 60 (more visible in FIG. 10). The outer edges of the wing segments 50 include downward extending tabs 36, 38.

Figure 8:
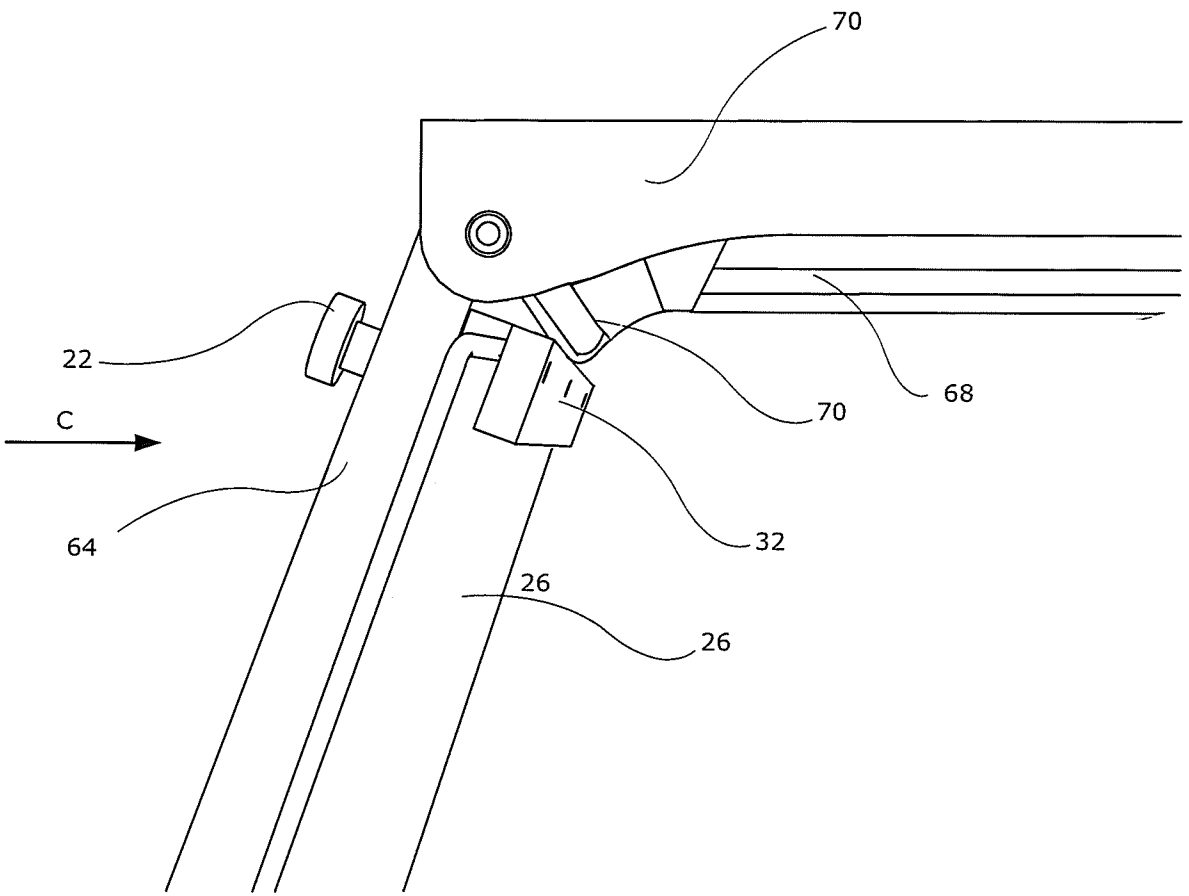
FIG. 8 is a perspective view, showing the position of down stop member when device is installed on a watercraft.

FIG. 7 illustrates a down stop member 32, which is a strip of solid material having three holes. Down stop member 32 can be connected to device 20 under primary plate 26 opposite handle 22. FIG. 8 illustrates down stop member 32 connected to primary plate 26, where device 20 is attached to watercraft 16. Down stop member 32 sits behind ladder 64 and can regulate the angle of device 20 and ladder 64 to prevent both from being pushed too far under the watercraft, towards the hull 68. If a force, shown as arrow C, is applied to device 20, down stop member 32 will contact ladder bracket 70 which is affixed to the underside of the watercraft 68.

Figure 9:
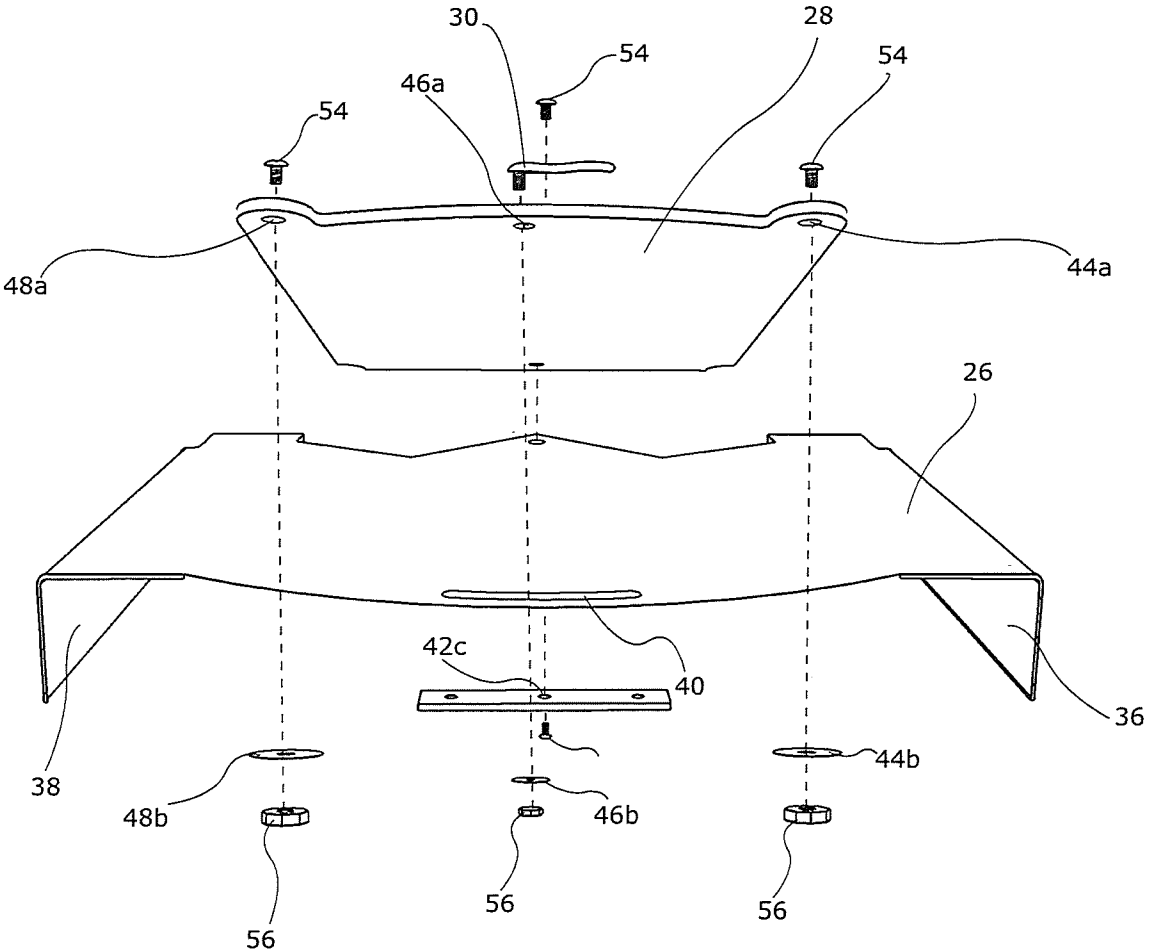
FIG. 9 is an exploded view, showing the component parts of the present device.
Figure 16:
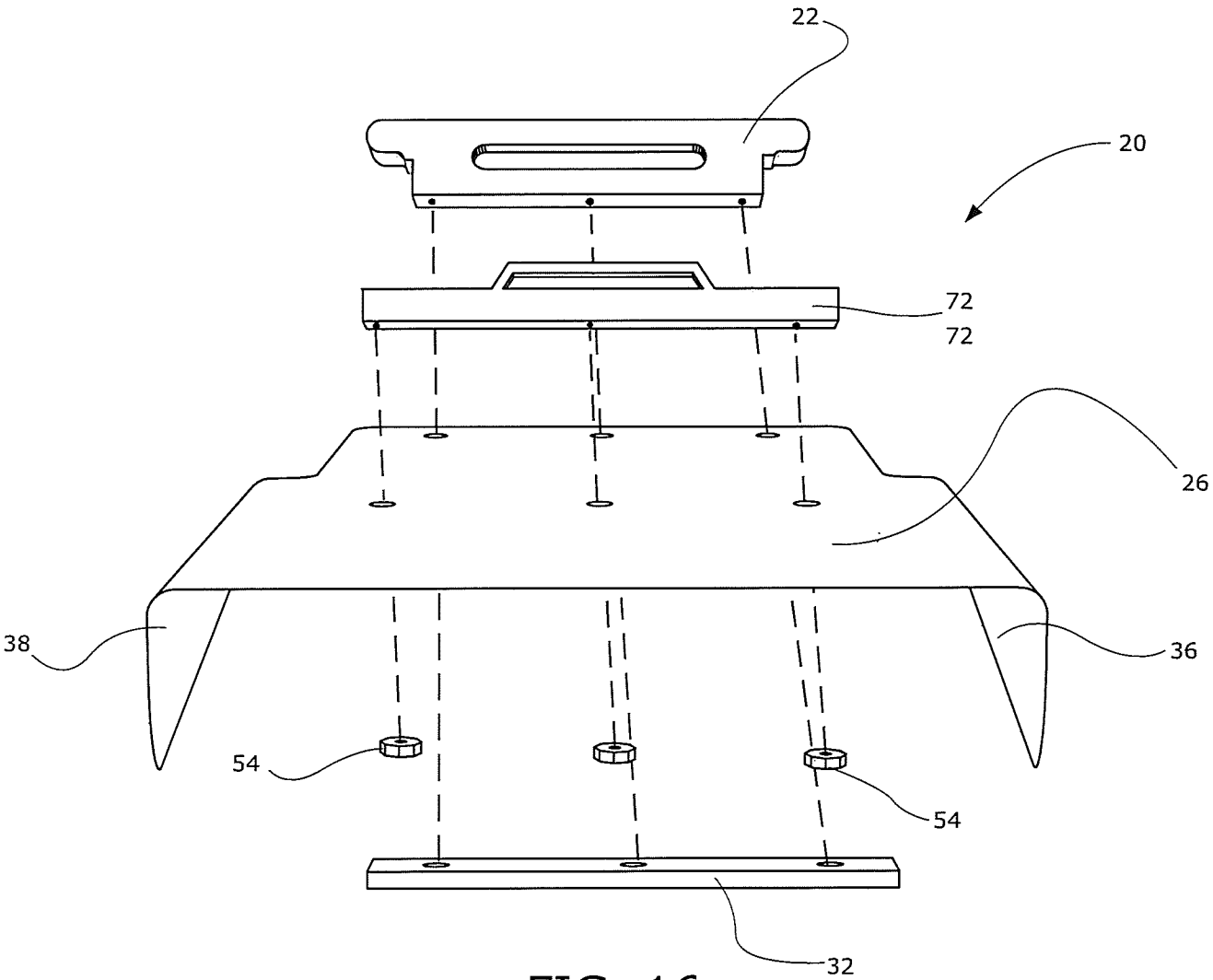
FIG. 16 is an exploded view, showing the component parts of the present device.

In the first embodiment of device 20, down stop member 32 is connected to secondary plate 28 by a bolt which passes through first hole 42*a* of secondary plate 28, first hole 42*b* of primary plate 26 and first hole 42*c* of down stop member 32, as further illustrated in FIG. 9. In one embodiment down stop member 32 is made of starboard, a marine grade plywood made from high density polyethylene. Additionally, down stop member 32 can act to secure handle 22 to device 20, as illustrated in FIG. 16.

Figure 10:
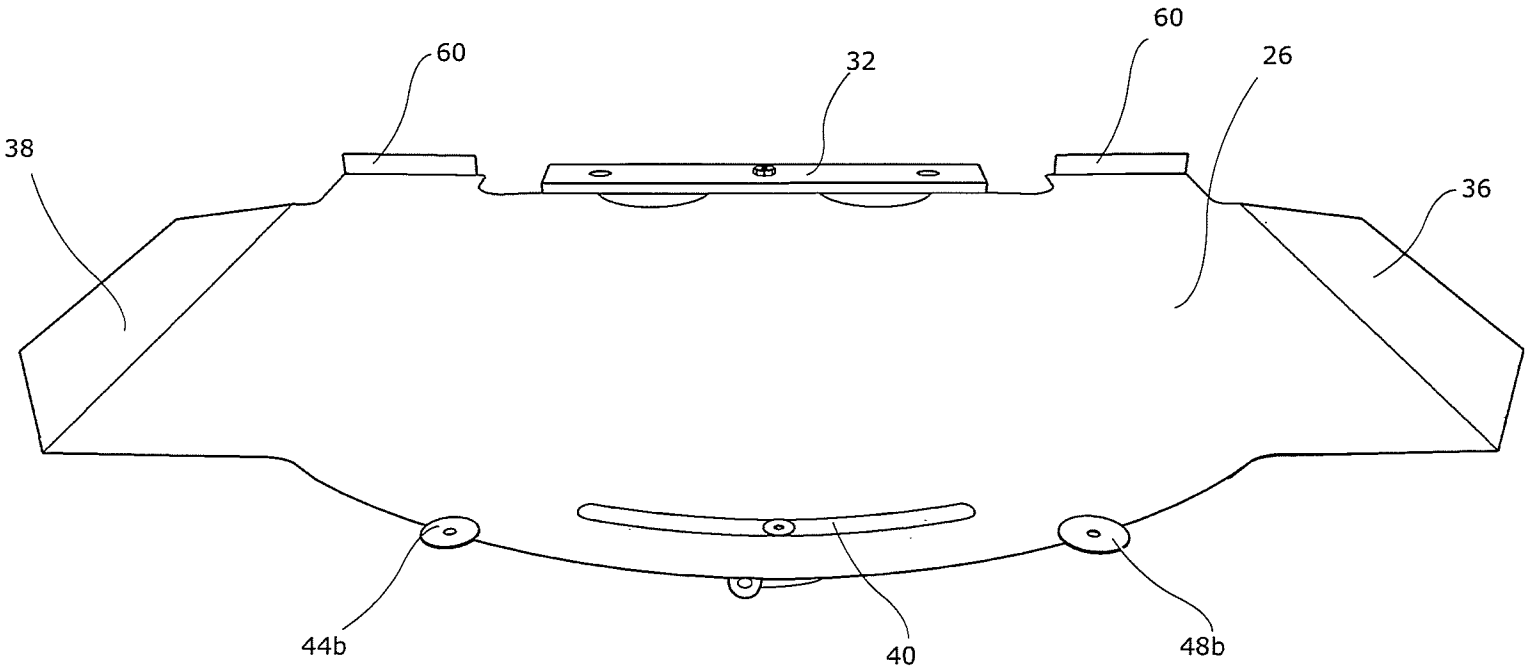
FIG. 10 is a perspective view, showing the bottom of the present device.

FIG. 9 is an exploded view showing the way the present device is assembled in one embodiment. The reader will appreciate that any known method of attaching primary and secondary plates together could be used to assembly device 20 so long as primary plate 28 is capable of pivoting with respect to secondary plate 26. In the present embodiment, secondary plate 28 is positioned over primary plate 26. A bolt 54 is inserted into holes 44*a* and 48*a* of secondary plate 28, bypassing primary plate 26 altogether, and extending through washers, 44*a* and 48*b* respectively (shown as dotted line). Although bolts 54 bypass primary plate 26, washers 44*a* and 48*b* do contact a portion of primary plate 26 when tightened (as shown in FIG. 10). A nut 56 secures each bolt 54 in place. A latch 30, which can be any known latching assembly, extends through adjustment hole 46*a* on secondary plate 28, through adjustment slot 40 on primary plate 26 and is secured to washer 46*b* and nut 56. When a user opens latch 30, the distance between the top and bottom plate enlarges slightly enough to allow a user to pivot primary plate 26 to the desired position along adjustment slot 40. Once in the desired position, the user can secure latch 30 (close latch) and primary plate 26 will be secured in position with respect to secondary plate 28.

FIG. 10 is a perspective view from underneath device 20. The two wing segments 50 (illustrated in FIG. 6) on primary plate 26 include an optional flap 60—flap extends perpendicularly (approximately 90 degrees) away from the horizontal plane of primary plate 26. Likewise, starboard tab 36 and port side tab 38, extend approximately perpendicularly away from the horizontal plane of primary plate 26. However, tabs 36, 38 can also be angled slightly outward away from the center of device 20. In all embodiments, an angle is formed between each tab 36, 38 and the central segment of primary plate. The optimal range of each angle is approximately 90 degrees to 120 degrees from the plane (as shown, a horizontal plane) of primary plate 26 (angled outward away from center of device 20). Starboard tab 36 and port side tab 38 are, in one embodiment, shaped such that the side of tab closest to stern of the watercraft tapers to a point. A left or right-side elevation view of device 20 would show tabs as trapezoidal in shape in the present embodiment.

Figure 12:
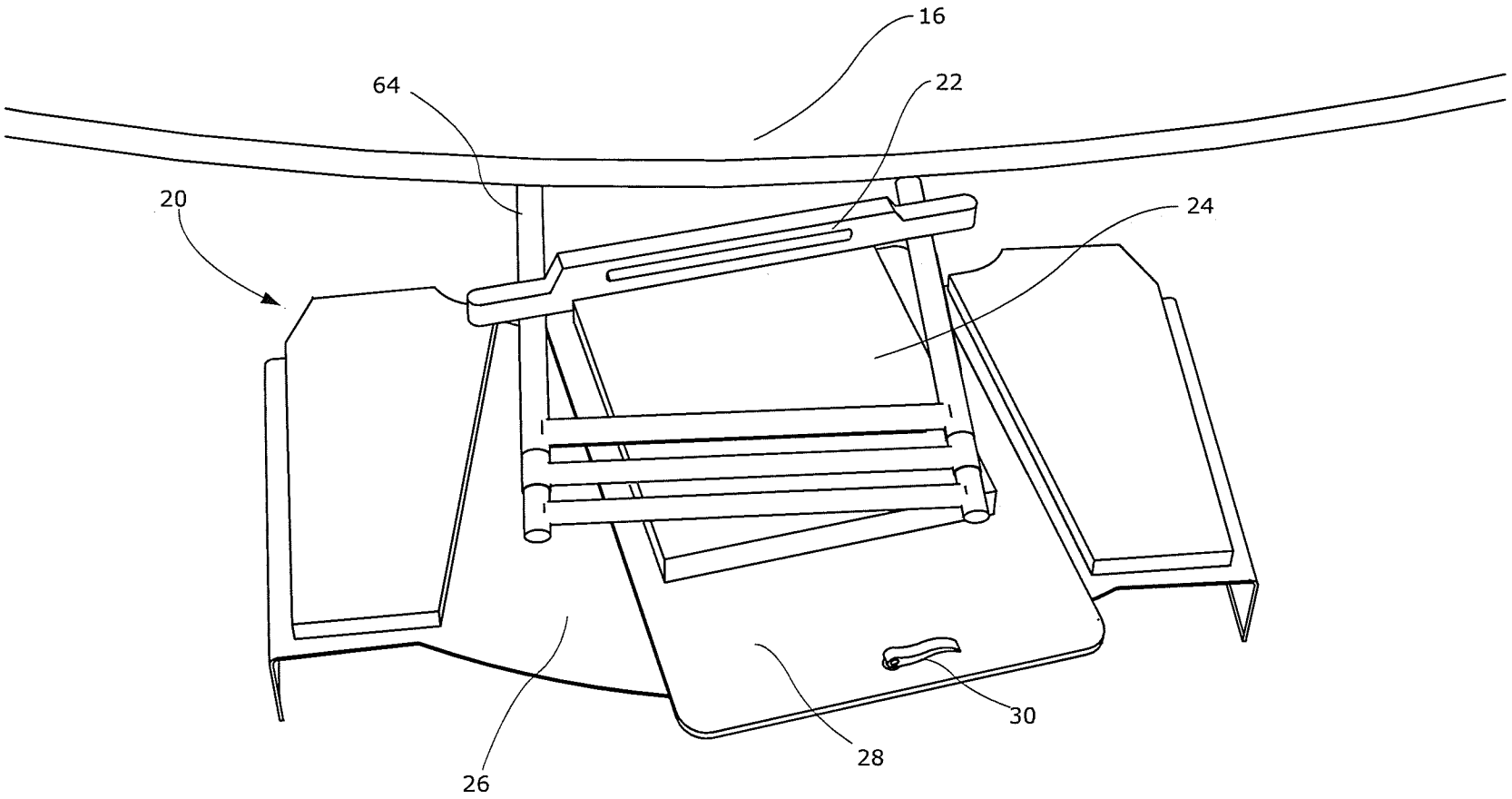
FIG. 12 is a perspective view, showing the method of installing the present device to a ladder extending from a watercraft.
Figure 17:
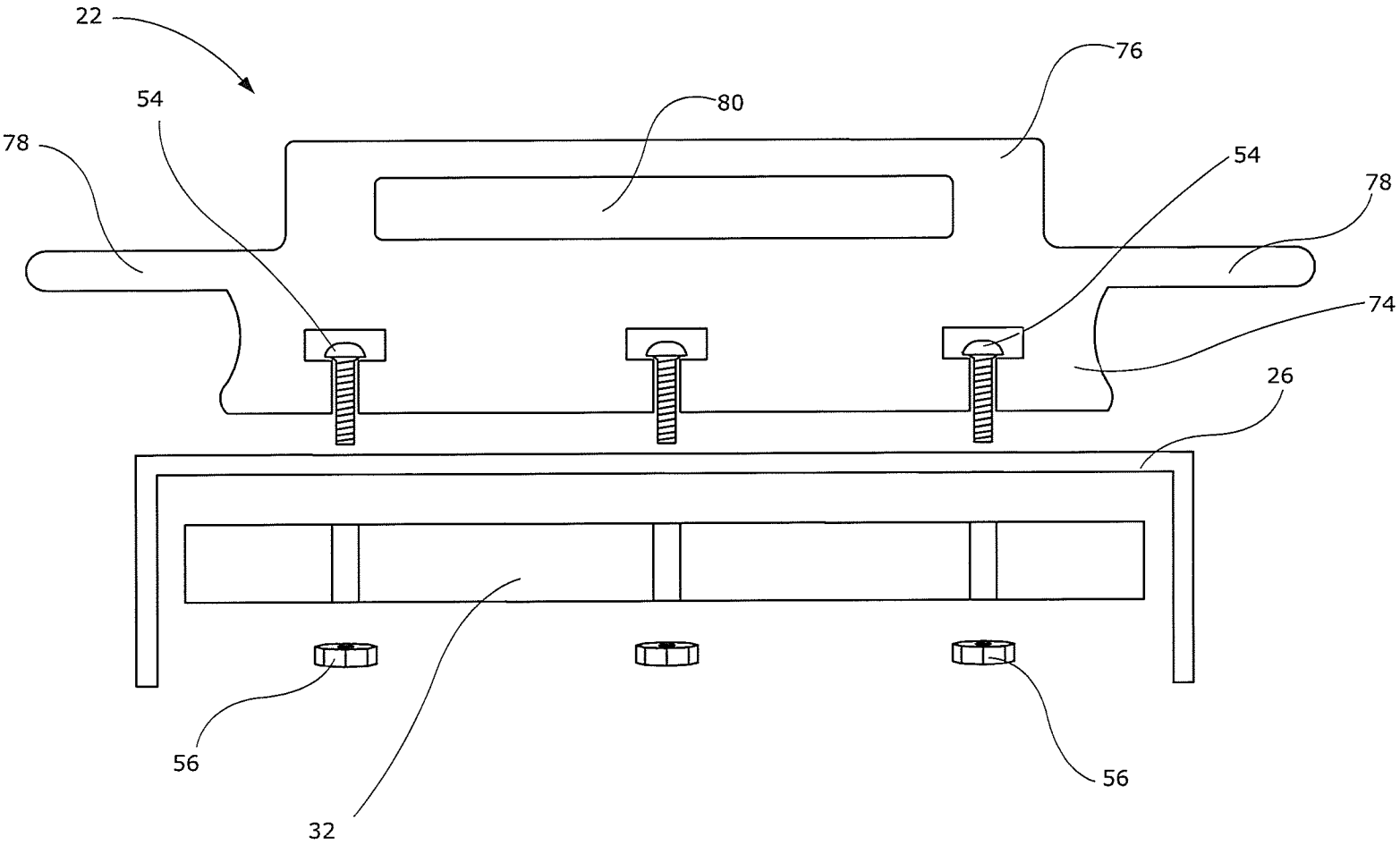
FIG. 17 is an exploded close up view, showing the component parts of the present device, specifically, the manner in which the handle attaches to primary plate and down stop member.

In one embodiment, device 20 can be directly attached to a prior art ladder 64 of watercraft 16, as shown in FIGS. 12-13. A method of redirecting water to produce a desired surfing wave is also provided herein, including the steps of providing, installing and using device 20 to create a desired wave as a watercraft moves through a body of water. To install, device 20 is first slid underneath a prior art ladder 64. The user positions device 20 at an angle with respect to ladder 64 and the opening formed by either side of ladder, rungs of ladder and the watercraft itself. This is shown in FIG. 12. Once handle 22 fits through the opening, the user can straighten out device 20. When in position, each arm 78 (shown in FIG. 17) on handle 22 rests on top of each side of ladder 64. Device 20 snaps into place, such that arm 78 of handle 22 is over ladder 64 and secondary plate 28 is underneath ladder 64, as illustrated in FIG. 13. Strap 66 extends from secondary plate 28 (or an attachment to secondary plate 28) and provides additional stability by extending around rungs of ladder 64 and back to secondary plate 28 (or attachment thereto). The foam piece 24 fits snugly into square opening in ladder 24 to provide additional security, while indicating a warning sign. Again, the foam piece 24 and wing foam pieces 34 provide buoyancy if a user drops device 20 in the water during installation, as device 20 will not sink. In an alternative embodiment, the device 20 can be mounted to a bracket directly on the watercraft. The position of the attachment to the watercraft 16 should be similar to that shown in FIGS. 12-13.

Figure 11:
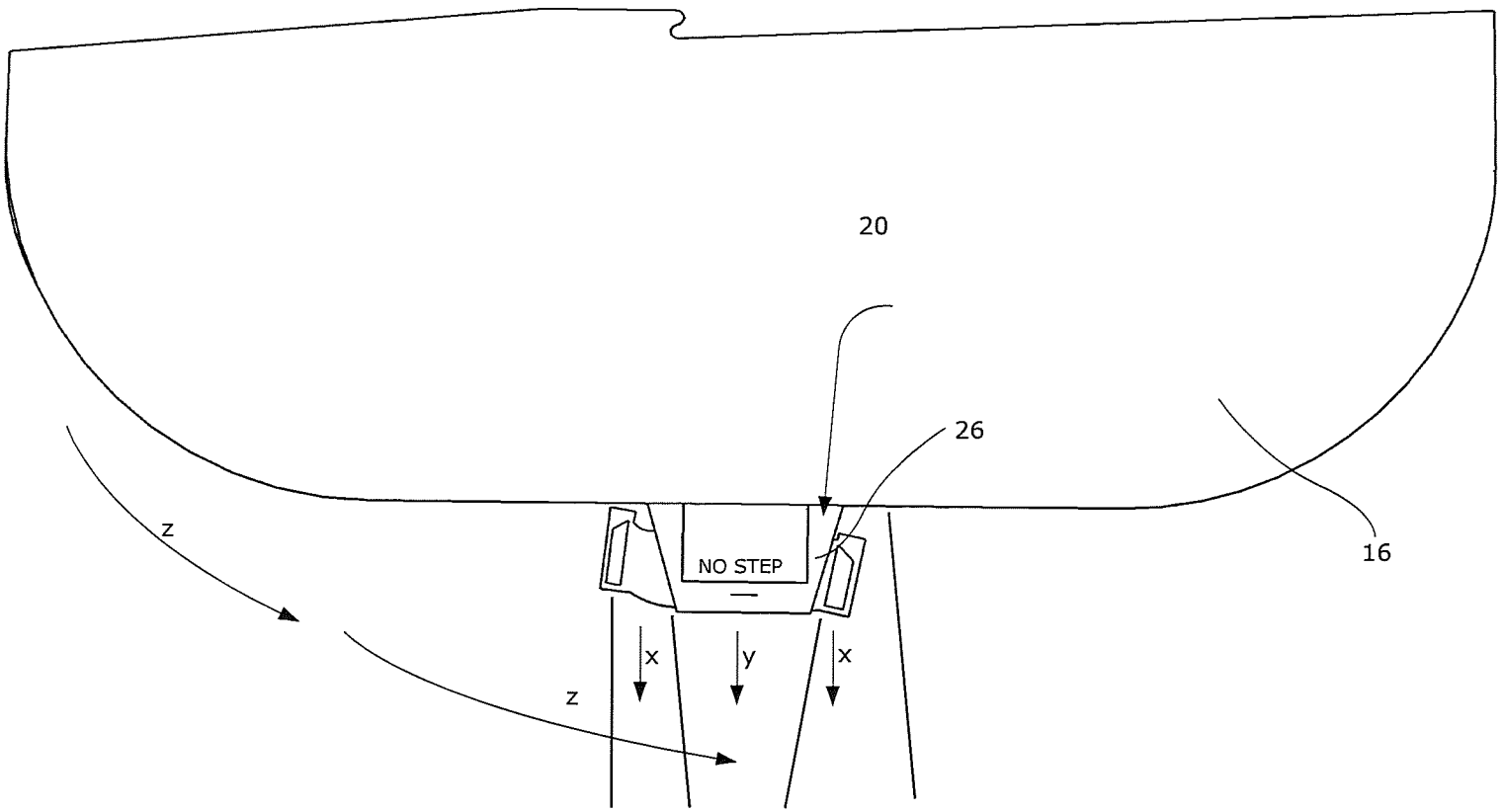
FIG. 11 is a schematic view, showing the present device installed on a watercraft and the resulting water flow patterns created by the present device.

FIG. 11 illustrates the redirected water flow using device 20 attached to watercraft 16, where primary plate 26 is shifted toward the port side of the watercraft 16. As a typical watercraft moves through a body of water, it displaces water and creates directed water flow. In FIG. 11, three different areas of water flow are shown. Arrows x indicate the flow created by each jet nozzle. This jet thrust is water flow existing jet nozzle. Each jet thrust is shown by arrows x and spreads (a tapered widening) as the water leaves each nozzle. In addition to the jet thrust there is also a considerable amount of water (particularly at the center of the stern) flowing outward and upward from the stern of the watercraft, as water is displaced by the hull's movement through the body of water. Finally, arrow z represents water flow around either side of the watercraft.

In the present position of device 20, tabs (not visible) and primary plate 26 redirect water escaping from beneath the watercraft 16, along with some amount of water from at least one jet thrust (exiting jet nozzle, each jet thrust shown by arrow x). This deflected flow, shown as arrow x and y, creates a vortex by directing said flow toward (in some cases beneath) jet thrust creating a counterclockwise rotation which allows water passing along the side of the boat (depicted by arrow z) to converge with the wake more easily. The convergence of the water creates more laminar flow that maintains a favorable environment for that converging flow, (flow of water from port side of watercraft 16), to pass over the jet thrust (arrow x) thereby dampening the effect of the volatile turbulent flow of the jet thrust and wake in general. In one embodiment, this deflected flow is redirecting the jet wash (escaping from underneath the boat) and jet thrust downward at a 20-degree angle (as well as redirecting flow angularly towards either side of the watercraft depending on how primary plate is pivoted). Converging flow (arrow z) causes the formation of a desirable surfing wave on the port side of the watercraft 16 (or starboard side if positioned accordingly). Using the present device, a speed of at or around 11 mph has been found to achieve the optimal wave. However, waves can still be created at various other speeds.

Figure 14:
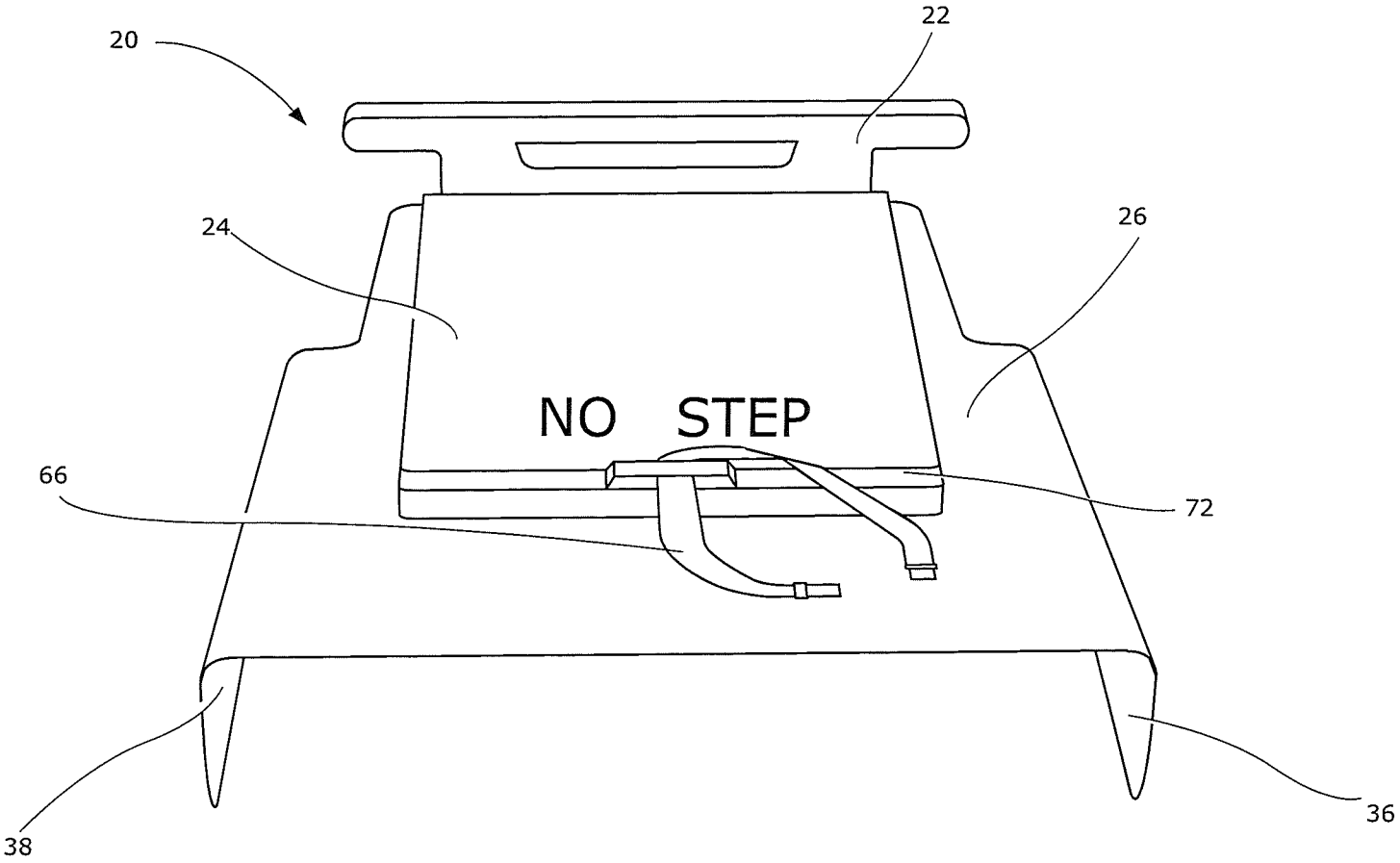
FIG. 14 is a perspective view, showing another embodiment of the present device.

FIG. 14, illustrates a second embodiment of device 20, preferably for use in connection with a 23-foot watercraft or shorter. In this embodiment, there is no secondary plate and primary plate 26 is stationary. Primary plate 26 generally includes a handle 22 (made up of two arm segments, base portion, top portion and an opening, illustrated in FIG. 17), down stop member 32 (shown in FIG. 16, for example), central foam piece 24, second handle 72 (including strap 66 with a connection mechanism), starboard side tab 36 and port side tab 38.

Figure 15:
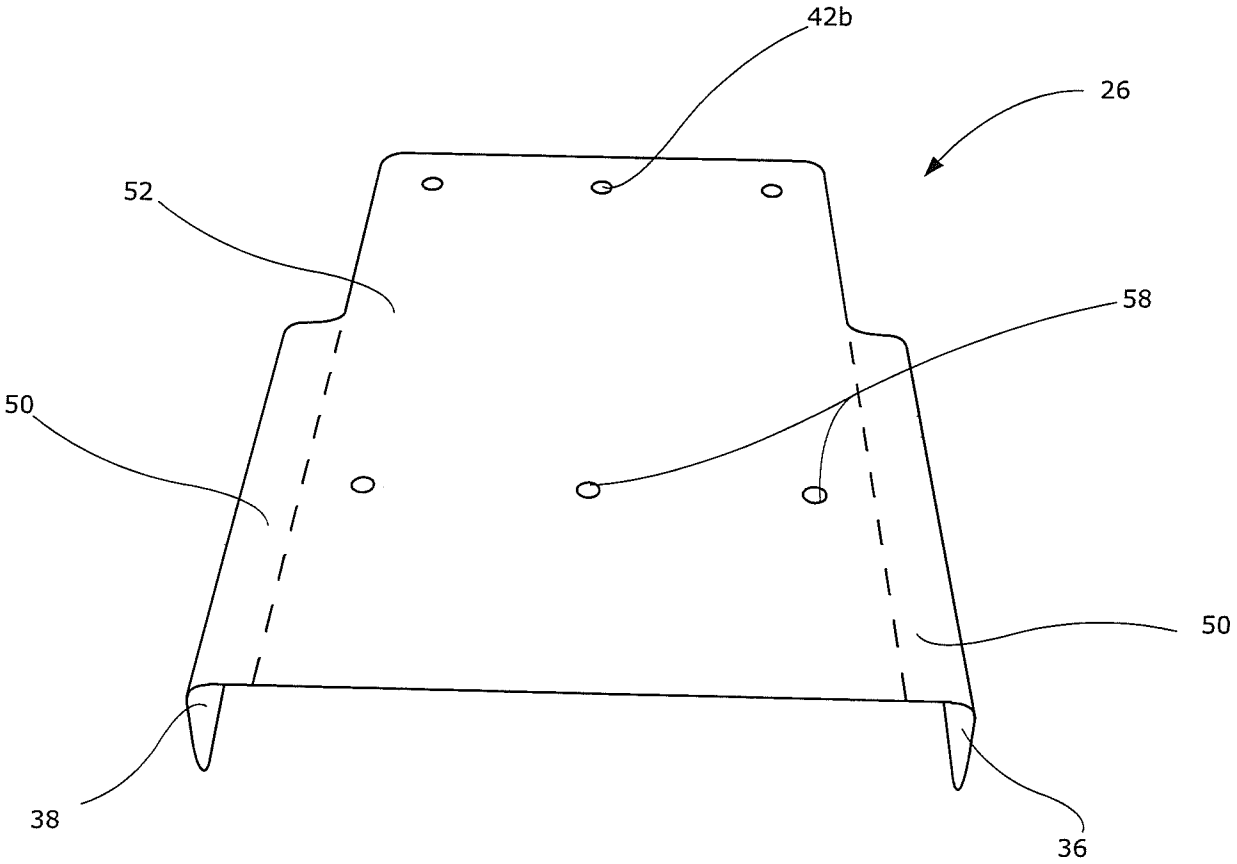
FIG. 15 is a perspective view, showing the primary plate of the present device.

Primary plate 26 is preferably one molded piece of material that includes downward turned starboard side tab 36 and port side tab 38, as shown in FIG. 15. Dotted lines are shown to illustrate the different segments of primary plate 26. Primary plate 26 includes a central segment 52, two wing segments 50 that include downturned tabs (36, 38). Central segment 52 has a series of holes 58. Series of holes 58 along middle of primary plate 26 accept bolts (not shown) which secure second handle 72 to primary plate 26 by way of a nut 54 or other mating mechanism (such as a barrel nut), as shown in FIG. 16. Handle 22 is attached to primary plate 26 by engagement with down stop member 32, further illustrated in FIG. 17. Handle 22 includes two arms 78, a top portion 76, base portion 74 and opening 80. Handle 22 can be any number of different shapes. Bolts 54 fit into an open cut-out on handle 22. The top of bolts 54 engage with handle 22, such that bolts 54 are unable to slip downward out of the open cut-out within handle 22. Bolts 54 pass through the series of holes 58 on primary plate 26 (as shown in FIGS. 15 and 16) and holes drilled through down stop member 32 (shown in FIGS. 7 and 16). A series of nuts 56 can be used to secure bolts 54 in place. In the alternative, a connector bolt (post and screw) can be used such that either side of the bolt/screw sits flush against the surface upon which they are being fastened. Additionally, the down stop member 32 could be fully integrated with primary plate 26.

Figure 18:
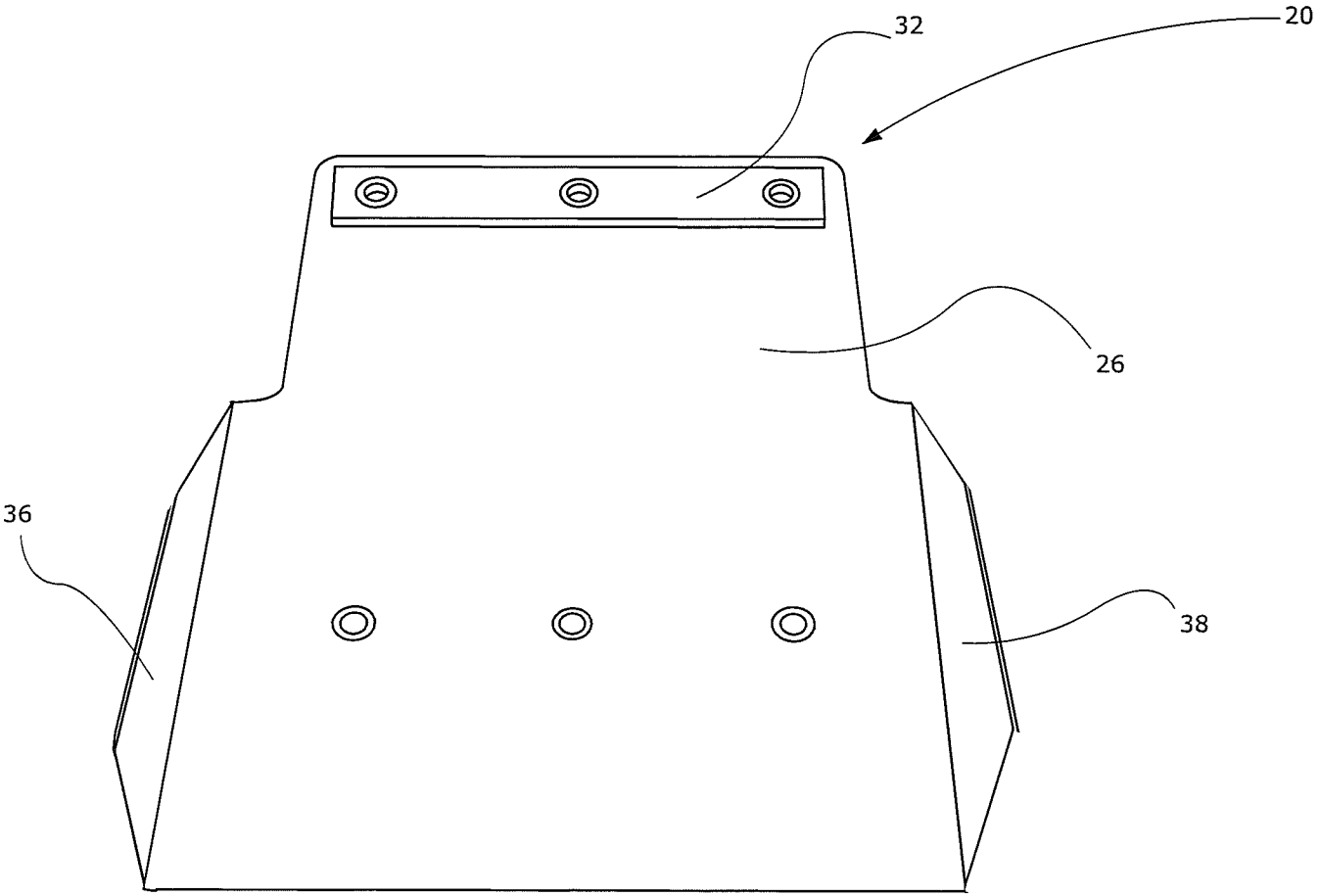
FIG. 18 is a perspective view, showing the bottom of the present device in the second embodiment.

FIG. 18 is a perspective view from underneath device 20. The starboard tab 36 and port side tab 38, in this image, extend upward (as device 20 is upside down) approximately perpendicular from the horizontal plane of primary plate 26. The optimal range of angular displacement of tabs (36, 38) from the horizontal plane is 90 to 120 degrees (angled outward away from the center of device 20). Starboard tab 36 and port side tab 38 are, in one embodiment, shaped such that the side of tab closest to stern of the watercraft, when installed, tapers to a point. A left or right-side elevation view of device 20 would show tabs as trapezoidal in shape in the present embodiment. Down stop member 32 is attached to device 20 as referenced herein.

Figure 19:
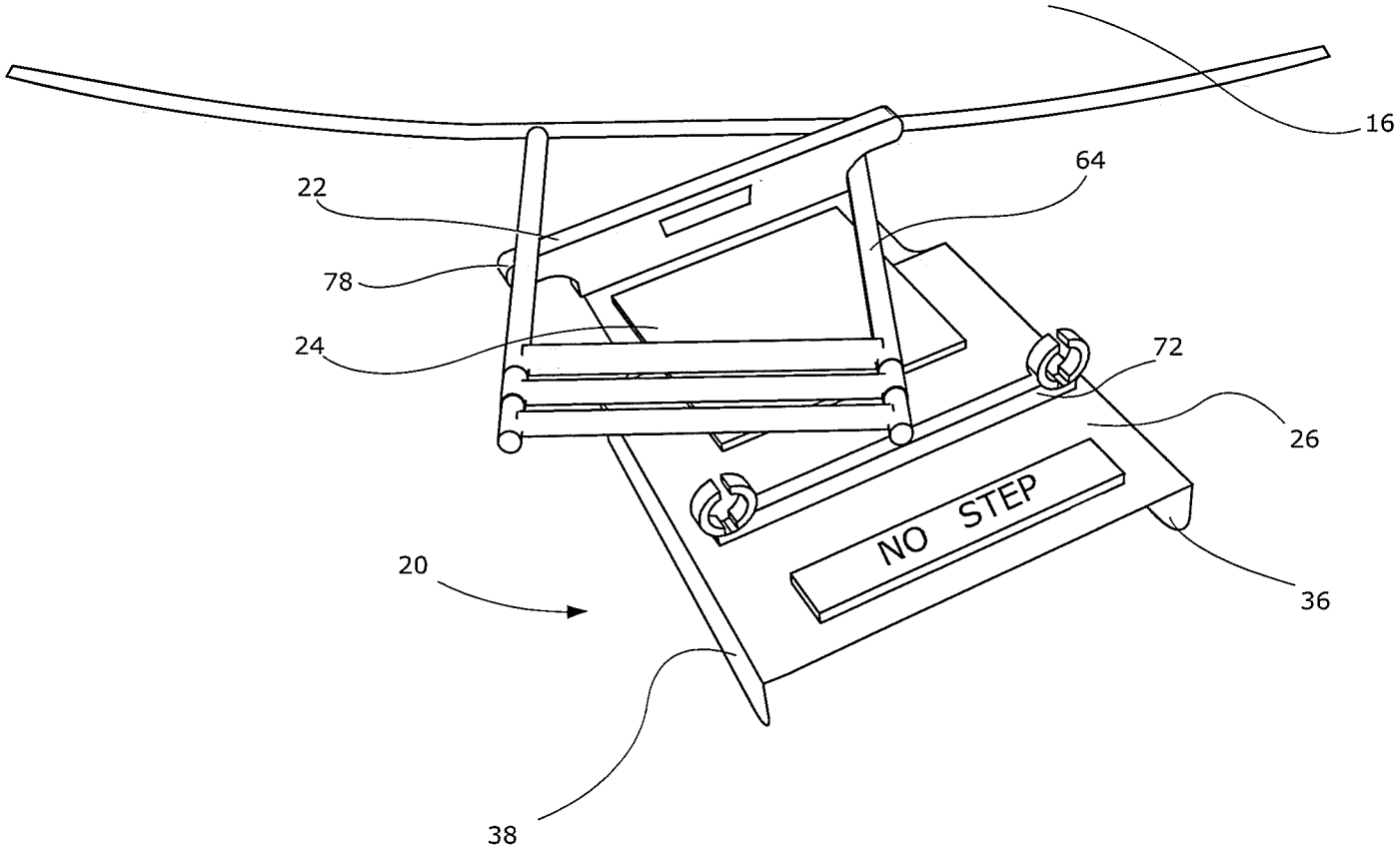
FIG. 19 is a perspective view, showing the method of installing the present device to a ladder extending from a watercraft.
Figure 20:
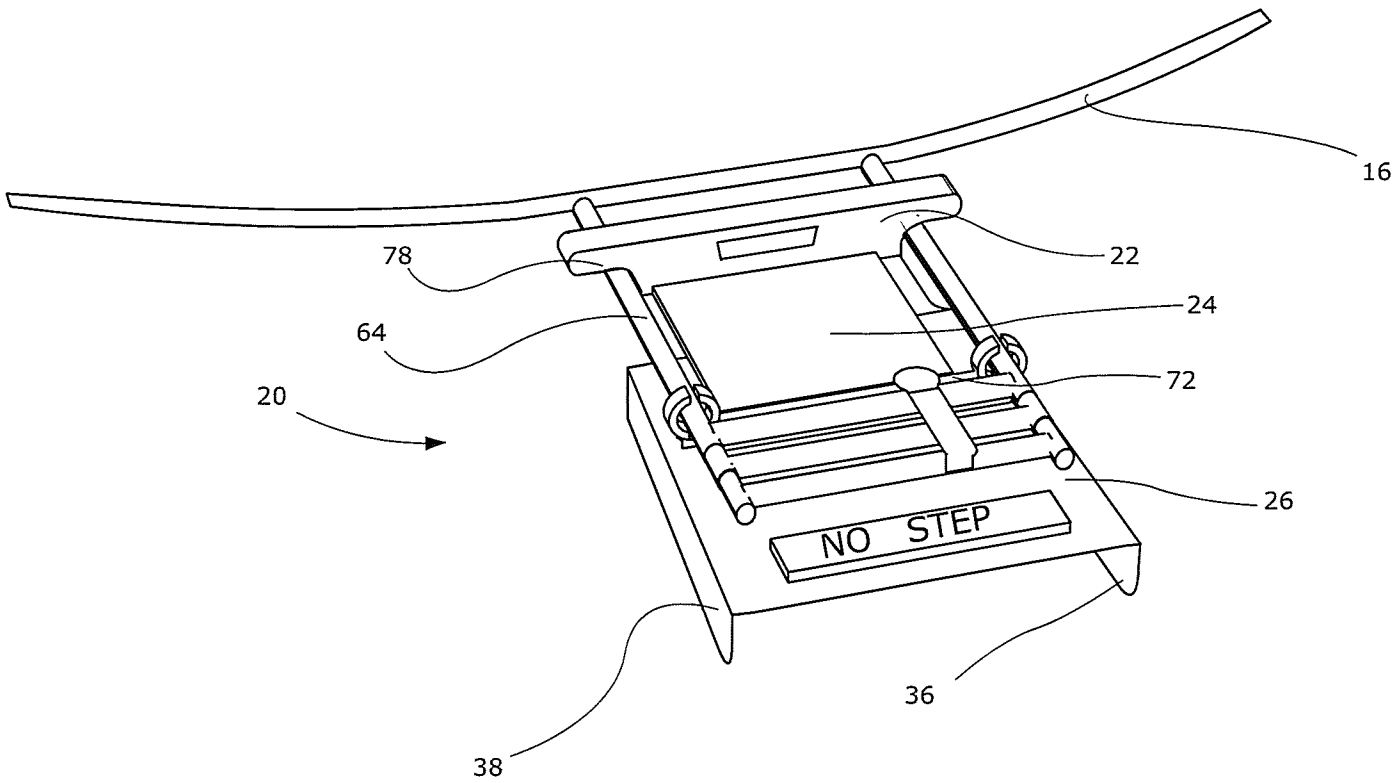
FIG. 20 is a perspective view, showing the present device installed on a ladder extending from a watercraft.

In its second embodiment, device 20 can be directly attached to ladder 64 of watercraft 16, similar to the manner shown and described in FIGS. 12-13. In this embodiment, shown in FIGS. 19-20, device 20 includes a modified second handle 72, including a ring on either end that slips onto either side of ladder 64. As previously described, device 20 is positioned underneath the ladder. The user holds device 20 at an angle proximate the rectangular opening formed by either side of ladder 64, rungs and the watercraft itself. In an angled position, arms 78 of handle 22 can fit through opening of ladder. Once handle 22 slides into opening, the user can push device upward such that handle 22 now is positioned above either side of ladder. The user then rotates device 20 back into the position shown in FIG. 20. As the user pivots device 20, each end of handle 22 engages over ladder 64 and snaps into place, such that either end of handle 22 rests on top of either side of ladder 64. Primary plate 26 remains under ladder 64, thereby engaging either side of ladder between handle 22 and primary plate 26. Second handle 72 rests proximate top rung of ladder 64. On either side of second handle 72 an engagement ring accepts the side of ladder 64, simultaneous with the user pivoting device 20. A strap 66 that extends through a gap in second handle 72 can be strapped around rungs of ladder 64. The foam piece 24 fits snugly into square opening in ladder 24 to provide additional security, while indicating a warning sign. Again, the foam piece 24 provides buoyancy if a user drops device 20 in the water during installation, as device 20 will not sink. In the alternative, the device 20 can be mounted to a bracket directly on the watercraft. Any direct mounting to the watercraft 16 should be done in a manner that approximates the position of the device shown in FIGS. 19-20 (proximate the center of the stern of the watercraft).

Figure 21:
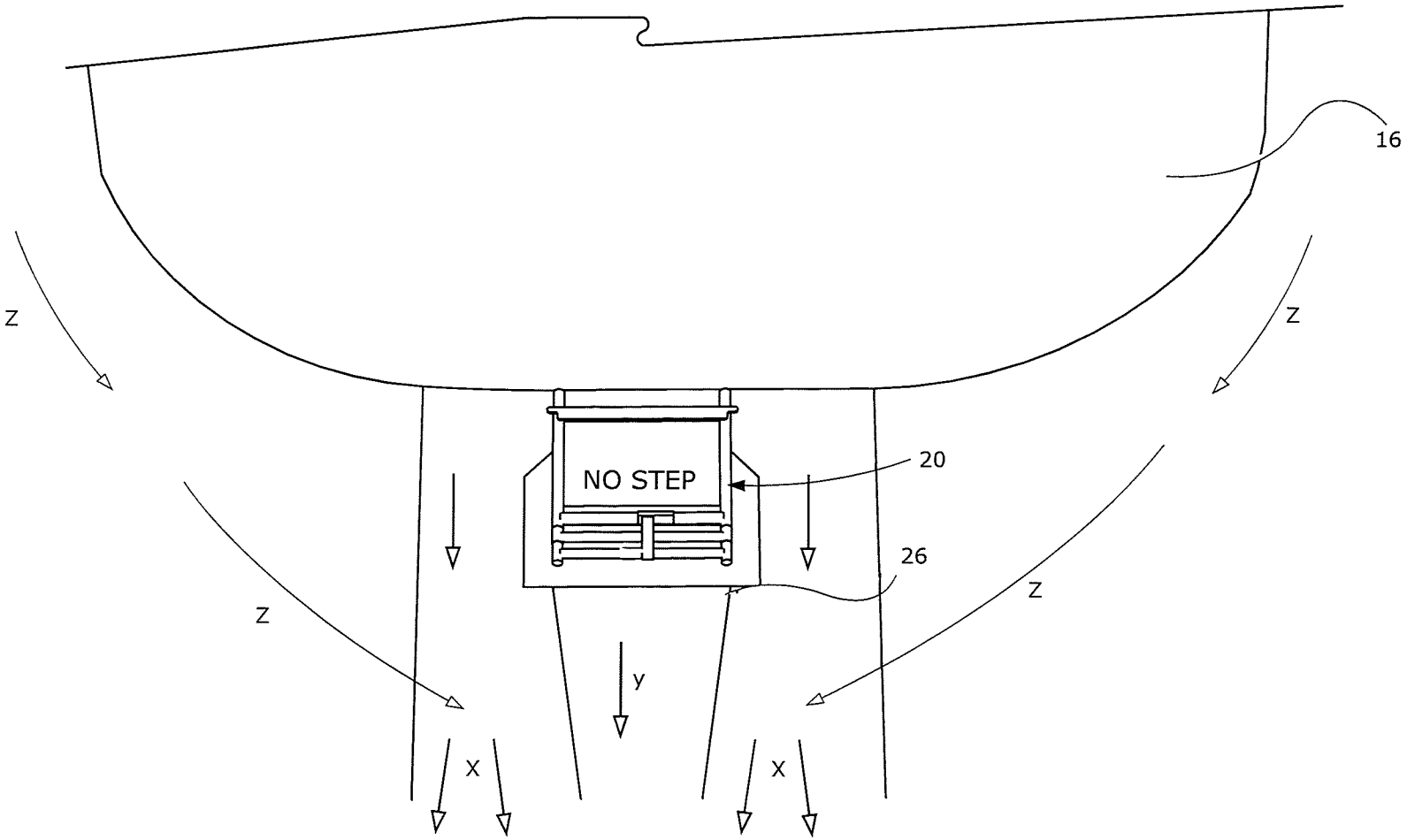
FIG. 21 is a schematic view showing the present device installed on a watercraft and the resulting water flow patterns created by the device.

FIG. 21 depicts the effect of the device 20 on the water flow around the boat. The flow of water as a watercraft moves through the water takes several paths. Arrows x represent water being expelled from jet nozzles. This jet thrust propels the watercraft forward but also creates flow in two streams behind the watercraft. Additional water flow displaced by the hull of the watercraft, shown by arrow y, also escapes upward behind the boat and joins the jet thrust. Collectively, this flow is referred to as the wake. Device 20 includes tabs (not visible) which, along with primary plate 26 itself, redirect a portion of the wake downward, delaying the upswell of water behind the watercraft and preventing spray. This deflected flow allows water passing along the side of the boat (depicted by arrow z) to converge with the wake more seamlessly. The convergence of the water creates more laminar flow that maintains a favorable environment for that converging flow, (flow of water from either side of watercraft 16), to pass over wake thereby dampening the effect of the volatile turbulent flow of the wake in general. In one embodiment, this deflected flow is redirecting the wake downward at a 20-degree angle. Converging flow (arrow z), now able to converge seamlessly with the wake, causes the formation of a desirable surfing wave. Using the present device, a speed of at or around 11 mph has been found to achieve the optimal wave. However, waves can still be created at various other speeds.

The preceding description contains significant detail regarding the novel aspects of the present invention. It should not be construed, however, as limiting the scope of the invention but rather as providing illustrations of the preferred embodiments of the invention.

Having described my invention, I claim:

1. A device for use on the stern of a watercraft, said device comprising:

a primary plate having a first point, a central segment along a first plane, two wing segments and at least two tabs;

wherein said at least two tabs are angularly displaced from said central segment such that an angle is formed between each of said at least two tabs and said first plane of said central segment;

a secondary plate having a first point, wherein said first point of said primary plate is pivotally attached to said first point of said secondary plate; and a handle having at least two arms attached to said secondary plate.

2. The device of claim 1, further comprises:

a latch assembly engaged with said secondary plate at an adjustment hole and with said primary plate at an adjustment slot; and wherein said latch assembly can secure said primary plate in a series of positions along said adjustment slot.

3. The device of claim 1, further comprising a second handle attached to said secondary plate.

4. The device of claim 1, further comprising a down stop member attached under said primary plate opposite said handle.

5. A method of redirecting a portion of the wake behind a watercraft having a port side, a starboard side, a ladder with two sides and a series of rungs, wherein said watercraft also has a flow of water around said port side and said starboard side, comprising the steps of:

providing a device having a primary plate attached to a handle having at least two arms, wherein said primary plate has a first point, a central segment along a first plane, two wing segments and at least two tabs, and wherein said at least two tabs are angularly displaced from said central segment such that an angle is formed between each of said at least two tabs and said first plane of said central segment;

positioning said device angularly under said ladder such that said handle of said device fits between said two sides of said ladder;

pushing said device upward toward said ladder such that said at least two arms of said handle rests on top of each of said sides of said ladder and said primary plate rests below each of said sides of said ladder;

driving said watercraft at a speed such that said device redirects said wake such that said flow of water around said port side and said starboard side of said watercraft can converge with said wake to create a surf wave.

6. The method of claim 5, wherein said angle between each of said at least two tabs and said first plane of said central segment is approximately 90 degrees.

7. The method of claim 5, wherein said angle between each of said at least two tabs and said first plane of said central segment is in the range of 90 degrees to 120 degrees.

8. A method of redirecting a portion of the wake behind a watercraft having a port side, a starboard side, a ladder with two sides and a series of rungs, wherein said watercraft also has a flow of water around said port side and said starboard side, comprising the steps of:

providing a device having a secondary plate attached to a handle having at least two arms, and a primary plate pivotally attached to said secondary plate at a first point, wherein said primary plate has a central segment along a first plane, two wing segments and at least two tabs, and wherein said at least two tabs are angularly displaced from said central segment such that an angle is formed between each of said at least two tabs and said first plane of said central segment;

positioning said device angularly under said ladder such that said handle of said device fits between said two sides of said ladder;

pushing said device upward toward said ladder such that said at least two arms of said handle rests on top of each of said sides of said ladder and said secondary plate rests below each of said sides of said ladder;

pivoting said primary plate toward at least one of said sides of said watercraft;

securing said primary plate in place with respect to said secondary plate;

driving said watercraft at a speed such that said device redirects said wake such that said flow of water around said at least one of said sides of said watercraft can converge with said wake to create a surf wave along said side of said watercraft that said primary plate is pivoted towards.

9. The method of claim 8, wherein said angle between each of said at least two tabs and said first plane of said central segment is approximately 90 degrees.

10. The method of claim 8, wherein said angle between each of said at least two tabs and said first plane of said central segment is in the range of 90 degrees to 120 degrees.

* * * * *